US007273393B2

(12) United States Patent
van Meijl

(10) Patent No.: US 7,273,393 B2
(45) Date of Patent: Sep. 25, 2007

(54) CONNECTOR SHELL FOR A MULTIPLE WIRE CABLE ASSEMBLY

(75) Inventor: Hermanus Franciscus Maria van Meijl, Neuss (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/567,884

(22) PCT Filed: Jul. 22, 2004

(86) PCT No.: PCT/US2004/023625

§ 371 (c)(1),
(2), (4) Date: Feb. 9, 2006

(87) PCT Pub. No.: WO2005/025010

PCT Pub. Date: Mar. 17, 2005

(65) Prior Publication Data

US 2006/0292933 A1 Dec. 28, 2006

(30) Foreign Application Priority Data

Aug. 29, 2003 (EP) ..... 03019714

(51) Int. Cl.
*H01R 9/05* (2006.01)

(52) U.S. Cl. ..... 439/579; 439/607; 439/610

(58) Field of Classification Search ..... 439/579, 439/607, 610

See application file for complete search history.

(56) References Cited

U.S. PATENT DOCUMENTS 3,825,874 A * 7/1974 Peverill ..... 439/579
4,405,187 A * 9/1983 Muller et al. ..... 439/608
4,917,616 A * 4/1990 Demler et al. ..... 439/101
4,941,831 A * 7/1990 Tengler et al. ..... 439/63
5,221,215 A 6/1993 Tan et al.
5,975,953 A 11/1999 Peterson
5,997,348 A * 12/1999 Shepherd ..... 439/579
6,210,230 B1 4/2001 Lai

FOREIGN PATENT DOCUMENTS

EP 0308092 A 3/1989
EP 0311041 A 4/1989
EP 0343561 A 11/1989
EP 0508255 A 10/1992
EP 0952637 A 10/1999

* cited by examiner

*Primary Examiner*—Tho D. Ta
(74) *Attorney, Agent, or Firm*—Melanie G. Gover

(57) ABSTRACT

The connector shell for a multiple wire cable assembly having multiple ground conductors and signal conductors comprises a housing having a ground potential, and a multitude of contact elements arranged in a longitudinal array. The contact elements are provided for making electrical contact to contact elements of a mating connector and comprise (i) grounding contact elements for connecting to the ground conductors of the multiple wire cable assembly and (ii) signal contact elements for connecting to the signal conductors of the multiple wire cable assembly. A longitudinal grounding plate extends along the array of the contact elements, the grounding plate having two lateral edges at least one of which is provided for electrical connection to the ground potential of the housing. The grounding plate comprises throughholes through which the grounding contact elements extend. At the throughholes, the grounding contact elements are electrically connected to the grounding plate.

19 Claims, 3 Drawing Sheets

CONNECTOR SHELL FOR A MULTIPLE WIRE CABLE ASSEMBLY

BACKGROUND OF THE INVENTION

1. Field of the Invention

The present invention relates to a connector shell for a multiple wire cable assembly having multiple ground conductors and signal conductors. Such a connector shell is used in particular for a multiple signal connector in the telecommunication industry.

2. Related Prior Art

Basically, for connecting coaxial cables to components of electrical equipment, connectors and termination sockets are used which are rotationally symmetrical with respect to their longitudinal axis. The design of these termination sockets provides a resistance behavior which is substantially identical to the behavior of the cable and, moreover, also provides a good shielding effect. Rotationally symmetrical coaxial cable termination sockets are disclosed in U.S. Pat. Nos. 4,943,245, 4,923,412, and DE 37 32 520. Due to the substantially cylindrical design of these known termination sockets, they are less suitable for miniaturization. Accordingly, a socket connector for receiving a plurality of these known termination sockets merely has a rather low density with regard to the number of coaxial cable termination sockets in the volume or space needed. However, the increased demands posed to electrical equipment, in particular information technology equipment such as in a telecommunication multiplexer, has led to a high signal density of connections i.e. a high number of cable connections in a limited space.

In order to design high density socket connectors for coaxial cable termination sockets it turned out that box-shaped coaxial cable termination sockets are suitable both with regard to miniaturization of the termination socket and the side-by-side arrangement of the termination sockets in a socket connector.

U.S. Pat. No. 4,762,508 discloses a socket connector for receiving box-shaped coaxial cable termination sockets. In each of the termination sockets for the coaxial cables, the two contacts (signal and ground) are arranged side-by-side and parallel and spaced apart in a housing comprising a shield. A plurality of these termination sockets are arranged in individual compartments or receiving portions of a socket connector body made of insulating material. The body is inserted into an enclosure which is built of metallic material and designed to have shielding properties.

A similar design of a socket connector for a plurality of coaxial cable termination sockets is disclosed in EP-B-0 284 245. In this reference as well as in U.S. Pat. No. 6,203,369 there is described a coaxial cable termination socket having two signal contacts for the signal conductors of two coaxial cables and one common ground contact arranged between the two signal contacts and connected with the shields of the two coaxial contacts. Moreover, box-shaped coaxial cable termination sockets also known as SCI connectors (shielded controlled impedance connectors) are described in U.S. Pat. No. 5,184,965, DE-C-41 16 168, and DE-C-41 16 166.

A certain disadvantage of coaxial cable termination sockets having a box-shaped design i.e. having a design which is non-coaxial, results in a loss of signal transmission and increase of signal reflection properties of the termination socket for high frequent signals in the MHz range.

While the box-shaped coaxial cable termination sockets basically are satisfactory concerning high density packaging aspects, there are limits concerning the speed and frequency of the signals transmitted through the termination sockets. With higher frequency in the GHz range the attenuation increases.

Attempts were made in the prior art to manage the above-mentioned problem by grounding or ground bussing. One possibility to do so is to interconnect the braid or shielding layer of each coaxial cable and to connect them to a metal strap as a ground contact at the connector. This arrangement does not provide positive grounding for each cable particularly with a high number of cables.

From U.S. Pat. Nos. 5,829,991, 5,775,924, 4,340,265, and EP-B-0 508 255, electrical connectors for several coaxial cables are described each having grounding means in the form of clamping and gripping elements for mechanically and, accordingly, electrically contacting the shielding layer or braid of the individual coaxial cables. However with such an arrangement it is not possible to transmit very high speed and frequency signals. Moreover, the assembly of the known socket connectors with the gripping ground means is rather time-consuming and cumbersome.

The use of a honeycomb grounding block to engage the outer conductors of several coaxial cables is disclosed in U.S. Pat. No. 4,889,500. This arrangement comprises many parts and does not meet the requirements of a cost-efficient solution for coaxial cable termination since it is expensive and complex to manufacture and assemble, respectively.

From EP-A-0 897 202, DE-C-43 44 328, and DE-A-33 41 356 it is known to contact the outer conductor of a coaxial cable by a special ground contact in the shape of a corrugated sleeve. The known corrugated sleeves are provided in the coaxial connectors in order to adapt the connector to coaxial cables different in diameter. In particular, the corrugated sleeves of adjacent coaxial connectors are not interconnected among each other.

Moreover, in the prior art it is known to use ground bussing strips for connecting the housings of box-like coaxial cable termination sockets. An example of such a socket connector is disclosed in U.S. Pat. No. 6,171,143 and EP-A-0 952 637. This socket connector is adapted to receive multiple coaxial cable termination sockets and includes two opposite longitudinal recesses which are adapted to expose parts of the outer conducting casings of the termination sockets. These exposed parts are contacted by a plurality of metallic fingers of two connecting elements formed as metallic strips. These connecting elements electrically connect the termination sockets with the outer casing components of the known socket connector which casing components are electrically conductive.

Moreover, from JP-A-11 074 037 another socket connector for a plurality of coaxial cable termination sockets is known, having a metal housing for receiving the termination sockets. Elastic cylindrical tube-like elements wrapped by a metal layer are inserted between the termination sockets and the metal housing so as to laterally contact the row of adjacent termination sockets.

From EP-A-0 311 041 another connector is known. This known connector comprises two mating connector parts one of which includes a housing in which a metal plate is arranged. The metal plate is provided with integral contact elements bent out of the plane of the metal plate for contacting ground pins of the other mating connector part. Moreover, the metal plate is provided with large through-holes having terminal connectors with signal contact elements extending therethrough wherein the signal contact elements receive signal pins of the mating connector part when the two connector parts are joined together. A further socket connector shell for receiving termination sockets of the cables of a multiple wire cable assembly is known from WO-A-03/012934. In this socket connector shell, between adjacent terminal sockets corrugated elements of an electrically conductive material are arranged as a ground bussing means.

In order to meet the demand for providing connectors suitable for very high-speed transmission of signals, grounding and, in particular, the grounding paths have to be improved.

SUMMARY OF THE INVENTION

It is an object of the present invention to provide a connector shell for a multiple wire cable assembly having an enhanced electrical performance so as to be suitable for very high-speed transmission of signals.

According to the invention there is provided a connector shell for a multiple wire cable assembly having multiple ground conductors and signal conductors, the connector shell comprising:

a housing having a ground potential, a multitude of contact elements arranged in a longitudinal array, the contact elements being provided for making electrical contact to contact elements of a mating connector and comprising:

(i) grounding contact elements for connecting to the ground conductors of the multiple wire cable assembly and (ii) signal contact elements for connecting to the signal conductors of the multiple wire cable assembly, a longitudinal grounding plate extending along and in the longitudinal direction of the array of the contact elements, the grounding plate having two lateral edges at least one of which is provided for electrical connection to the ground potential of the housing, wherein the grounding plate comprises throughholes having the grounding contact elements extending therethrough, and wherein at the throughholes the grounding contact elements are electrically connected to the grounding plate.

The connector shell according to the invention is provided with a housing and a multitude of contact elements arranged in a longitudinal array within the housing. The contact elements preferably are arranged in adjacent rows and comprise grounding contact elements and signal contact elements. Most preferably the contact elements comprise pins.

The contact elements of the connector shell according to the invention are provided for making electrical contact to contact elements of a mating connector. Accordingly, the contact elements form the interconnection part of the connector.

In order to commonly ground all of the grounding contact elements, a longitudinal grounding plate is arranged within the housing. The grounding plate extends along the array of the contact elements and comprises two longitudinal edges as well as two transverse edges.

According to the invention, at least one of the longitudinal edges is electrically connected to a ground potential of the housing. Preferably this is realized by the housing comprising an electrically conductive material such as e.g. metal and by the grounding plate being in electrical contact with the electrically conductive material of the housing.

Preferably, all the grounding contact elements of the connector shell according to the invention extend through the grounding plate or through the plane defined by the grounding plate. The grounding contact elements are in mechanical and electrical contact with the grounding plate in that the grounding contact elements extend through throughholes of the grounding plate at which the grounding contact elements are electrically connected to the grounding plate. The signal contact elements need not to extend through the grounding plate or the plane of the grounding plate. For instance the signal contact elements could bypass the grounding plate or could be extend above and beyond the lateral edges of the grounding plate.

Due to the arrangement according to the invention, all the grounding contact elements for grounding purposes are connected to the grounding plate which in turn along at least one of its longitudinal edges is connected to the ground potential of the housing. This means that there are comparatively short grounding paths from each grounding contact element transversely through the grounding plate to its at least one grounded longitudinal edge. Due to these very short grounding paths, impedances are very low and, therefore, high-speed transmission of signals in the connector shell is possible.

The signal contact elements of the connector shell according to the invention can extend through the grounding plate or pass adjacent thereto. In the latter case the signal contact elements can be arranged for example along a longitudinal edge of the grounding plate outside thereof. If the signal contact elements extend through the grounding plate no electrical contact between the signal contact elements and the grounding plate is given. For example, the signal contact elements can extend through cut-out sections built in the grounding plate wherein several signal contact elements can extend through a common cut-out section or each signal contact element extends through a cut-out section of the grounding plate associated to the respective signal contact element. Within the cut-out section the signal contact elements are spaced apart from the edge of the cut-out section which is designed as a throughhole. A gap is provided between the signal contact element and the edge of an associated cut-out section or throughhole. As an alternative, if the signal contact element is covered by an electrically insulating material (like a jacket) the insulation may contact the edge of the cut-out section but not the signal contact element itself.

Preferably the grounding plate is provided with one cut-out section extending along the longitudinal direction of the grounding plate and having all of the signal contact elements of one row or all of the rows of the signal contact elements extending therethrough.

According to a preferred embodiment of the present invention, the longitudinal array of contact elements comprises four adjacent rows of contact elements, with the two outer rows comprising the grounding contact elements and the two inner rows comprising the signal contact elements. In such an arrangement the grounding plate can be designed like a frame having longitudinal edges and transverse edges wherein all of the edges surround a central cut-out section through which the signal contact elements of the two inner rows of contact elements extend. The arrangement of the grounding contact elements at the longitudinal outer sides of the contact element provides for very short grounding paths and, accordingly, enhances the electrical performance of the connector shell.

Electrical connection between the grounding contact elements and the grounding plate at the throughholes thereof can be realized e.g. by soldering. However, with regard to assembling the connector shell, press-fit contacts between the grounding contact elements and the grounding plate are preferred. In a press-fit contact the grounding contact element is frictionally received in the respective throughhole of the grounding plate. Press-fit contact elements are basically known to those skilled in the art and, in particular, are known as compliant pins making permanent connection to the grounding plate by frictional engagement only.

In another embodiment of the present invention, the grounding plate comprises a support layer of a non-conductive material and an electrically conductive layer supported by the support layer. In this arrangement, the electrically conductive layer extends into the throughholes which receive the grounding pins. Accordingly, these throughholes are designed as vias basically known from printed circuit boards.

However, more preferably, the grounding plate is made of metal and, accordingly, is designed as a metal plate.

According to another embodiment of the present invention, the grounding plate can be an integral part of the housing or a portion thereof. However, it is preferred that the grounding plate is separated from the housing and can be mounted thereto e.g. by screws. Between the plate and the housing there can be arranged an electrical gasket for shielding potential gaps between the grounding plate and the housing. Those gaskets are basically known to persons skilled in the art.

As already mentioned above, the housing has a ground potential. This ground potential can be realized by a conductive layer arranged along the walls of the housing. Accordingly, the housing can comprise a wall of a non-conductive material which is coated by a layer of conductive material forming the ground potential. To obtain a suitable electromagnetic interference (EMI) shielding, the interior of the housing should be designed as a Faraday cage as basically known to those skilled in the art. In that regard it is most preferred that the housing comprises metal walls.

DESCRIPTION OF A PREFERRED EMBODIMENT OF THE INVENTION

Figure 1:
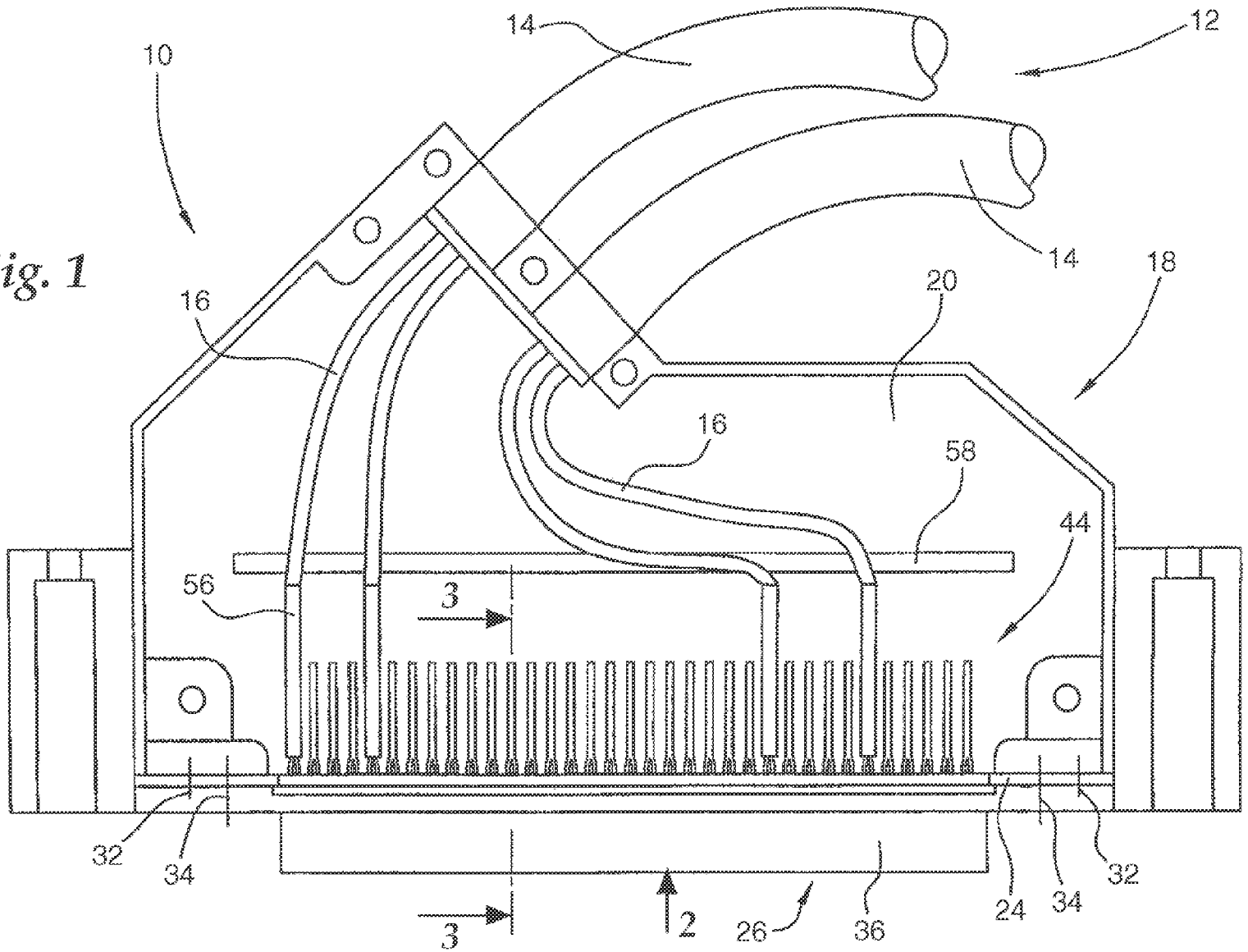
FIG. 1 shows the interior of one half of a connector shell according to a preferred embodiment of the invention.

In FIG. 1 there is shown the interior of a connector shell 10 for a multiple wire cable assembly 12 which in this embodiment comprises two multiple wire cables 14 each of which has several wires 16 comprising a ground conductor and a signal conductor each (both not shown). In this embodiment the cables 14 comprise coaxial cables. However, other types of cables known for telecommunication purposes for instance twinaxial cables or drain wire cables can be used. The type of cable is not relevant for the invention. The connector shell 10 comprises a housing 18 including two housing halves 20,22 one of which is shown in FIG. 1 while both of them are shown partially in FIG. 3. The halves 20,22 of the housing 18 are made of metal and, accordingly, are designed as a Faraday cage. As an alternative to solid metal housing halves 20,22, the housing can be made of a non-conductive material (i.e. synthetic material) provided with a layer of an electrically conductive material. This electrically conductive material layer should be arranged at the inner side of the housing halves 20,22 so as to contact (electrically and mechanically) a grounding plate which will be explained hereinbelow.

At a lower side of the connector shell 10 opposite to its upper side receiving the multiple wire cable assembly 12, there is arranged an opening in the housing 18 covered by an electrically conductive grounding plate 24 and a socket connector 26. The grounding plate 24 is shown in more detail in FIG. 2 and has a rectangular shape comprising two lateral edges 28 as well as two transverse edges 30. The other features of the grounding plate 24 will be explained later.

The grounding plate 24 is mounted to the housing 18 by means of screws 32. However, other types of mechanical fasteners or mechanical fastening systems like clamps or the like can also be used. Also welding, adhering or the like can be used for mechanical connection of the grounding plate 24 and the housing 18.

Moreover, in front of the grounding plate 24 there is arranged within the opening of the housing 18 the socket connector 26 attached to the housing 18 by means of screws 34. The socket connector 26 comprises a block 36 of electrically insulating material supports a plurality of grounding contact elements 40 and signal contact elements 42 arranged in rows and columns so as to form an array 44 of contact elements 46. In this embodiment the array 46 comprises four rows of contact elements 46, two of them comprising the grounding contact elements 40 and the other two comprising the signal contact elements 42.

In this embodiment the contact elements 46 each comprise a pin section 48 (male portion), a middle section 50 capable of frictionally engaging with the grounding plate 24 (which is true for the grounding contact elements 40 only), and another portion 52 (socket or female portion) for electrical contact with a pin section of a mating contact element of a mating connector element (not shown). The female portions are inserted in the block 36. A socket connector 26 as described above and shown in the Figures is basically known to those skilled in the art.

As shown in FIG. 1, each of the cables 16 is provided with a terminal connector 54 having a housing 56 of electrically conductive material. Within the housing 56 there is arranged a signal contact element (not shown) which is electrically insulated relative to the housing 56 and electrically connected to one of the signal contact elements 42. Moreover, within the housing 56 there is also arranged a ground contact element (not shown) electrically insulated relative to the signal contact element of the housing 56 and electrically connected to the housing 56 and one of the grounding contact elements 40 of the array 44 of contact elements 46. In FIG. 1 as well as in FIG. 3, the terminal connectors 54 are SCI connectors including one signal contact element and one grounding contact element. However, other types of terminal connectors and, in particular, terminal SCI connectors like e.g. those including two signal contact elements and one common ground contact element can also be used. Moreover, the conductors of the cables 16 can also be directly connected to the contact elements 46 by e.g. wire wrapping.

Figure 3:
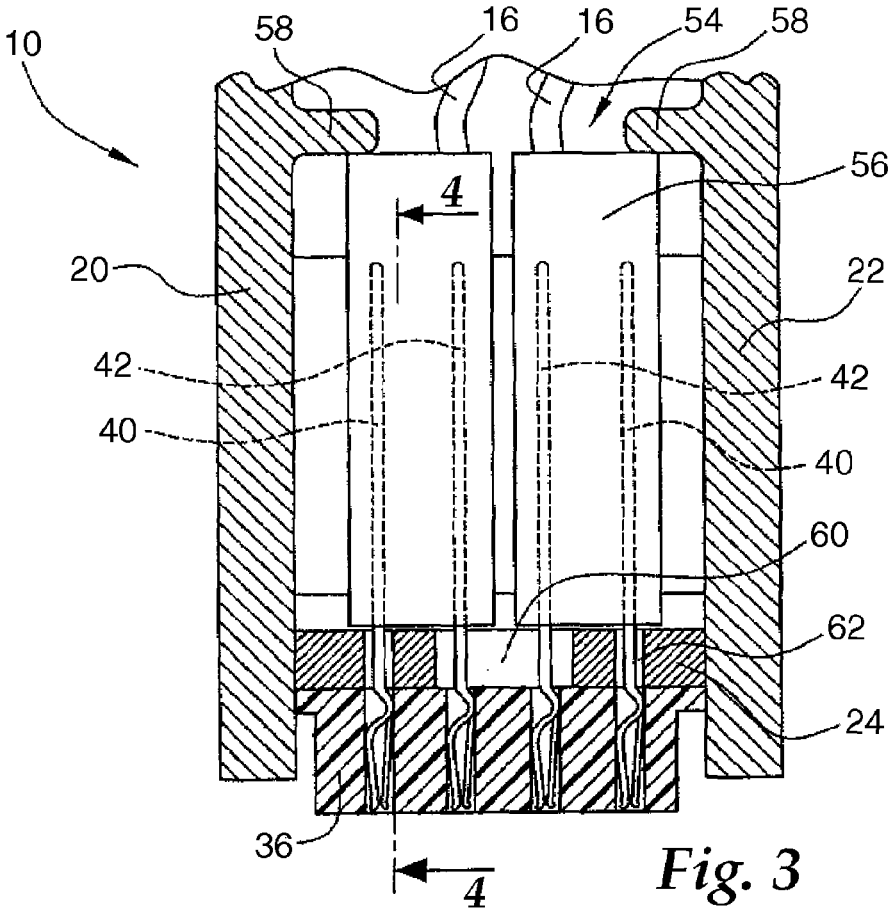
FIG. 3 is a sectional view, taken along line III-III of FIG. 1. of a completely assembled connector shell.

As can be seen in particular from FIGS. 1 and 3, the terminal connectors 54 receive the contact elements 46 of the contact element array 44. Due to this arrangement, the signal conductors of the cables 16 are electrically connected to the signal contact elements 42 and the ground conductors of the cables 16 are connected to the ground contact elements 40 of the contact element array 44. As shown in FIG.

3, the terminal connectors 54 are held in place by means of protruding ribs 58 projecting from the inner surfaces of the housing halves 20,22 and being arranged above the housings 56 of the terminal connectors 54 so as to prevent the terminal connectors 54 from inadvertently releasing from the contact elements 46.

One of the main aspects of the present invention is the electrical connection of the grounding contact elements 40 to the grounding plate 24 as well as the electrical connection of the grounding plate 24 to the housing 18.

Figure 2:
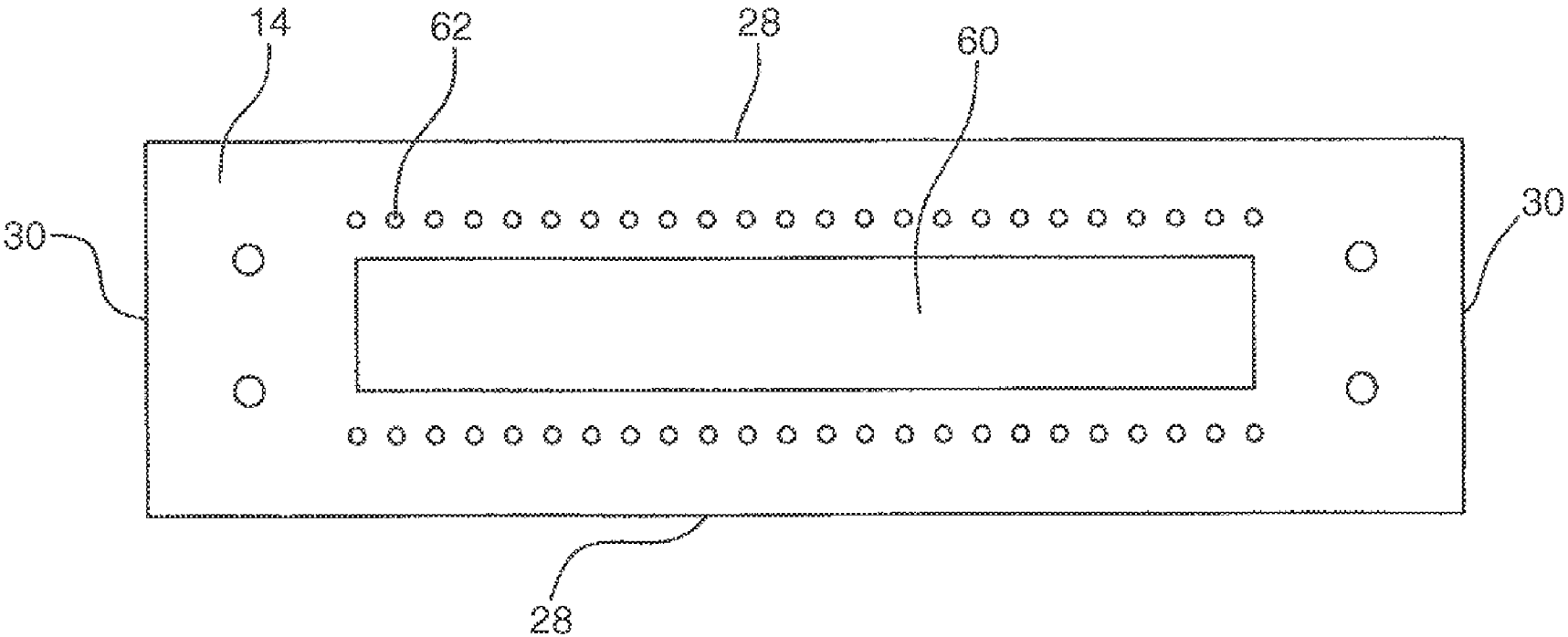
FIG. 2 shows a preferred embodiment of a design of the grounding plate for a four-row contact element array.
Figure 4:
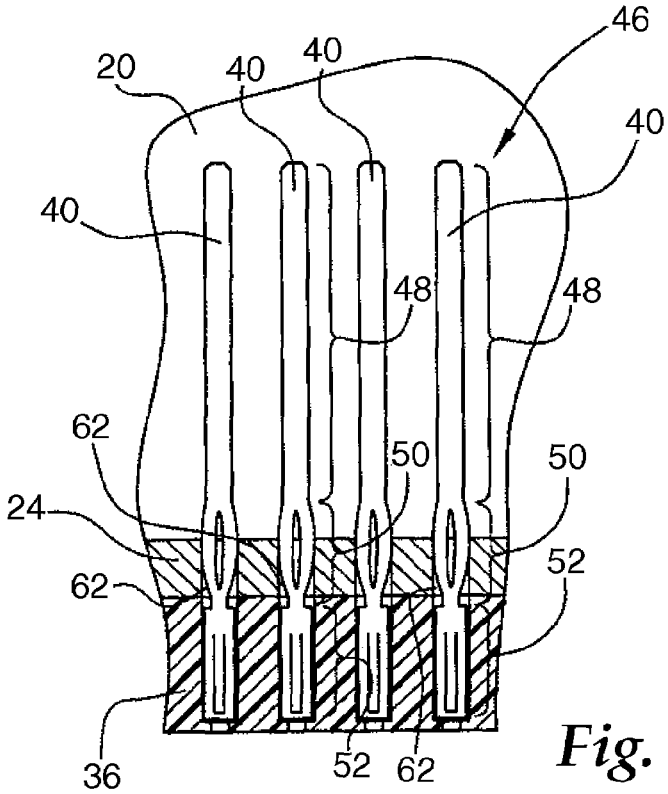
FIG. 4 is a cross-sectional view taken along line IV-IV of FIG. 3.

As can be seen from FIG. 2, the grounding plate 24 is shaped like a frame having a central cut-out portion 60 and two rows of throughholes 62 arranged adjacent the cut-out section 60 at opposite sides thereof and adjacent to the lateral edges 28. A cut-out section 60 is dimensioned such that all of the signal contact elements 42 which are arranged within the central portion of the array 44 of contact elements 46 extend through the cut-out section 60 without contacting the grounding plate 24 (see also FIG. 3). In contrast thereto, the individual throughholes 62 of the grounding plate 24 have a size such that the middle portions 50 of the grounding contact elements 40 frictionally engage the grounding plate 24 within the throughholes 62 (see FIG. 4). Accordingly, all the grounding contact elements 40 are grounded to the grounding plate 24 which contacts the inner surfaces of the housing halves 20,22 (see FIG. 3) and, accordingly, is grounded along both its lateral edges 28. However, it is to be noted that for the invention it is merely necessary that one of the lateral edges 28 of the grounding plate 24 is electrically connected to the ground potential of the housing 18 which ground potential in this embodiment is provided by one of the housing halves 20,22.

As can be seen from FIG. 2, the grounding paths along the grounding plate 24, i.e. the distance between the throughholes 62 and the lateral edges 28, are relatively short, which enhances the electrical performance of the connector shell 10 since signal transmission can be performed with very high speed.

It is to be noted that the design of the grounding plate 24 according to FIG. 2 is merely one alternative of a plurality of possible designs. For example, the contact element array 44 can also comprise two grounding contact element rows and two signal contact element rows wherein the two grounding contact element rows are arranged adjacent to each other and between the two signal contact element rows. In such an arrangement it is also possible that the grounding plate at its grounded lateral edge comprises individual throughholes having extending therethrough without contact therewith the signal contact elements of the signal contact element row located adjacent to the grounded lateral edge of the grounding plate, while the grounding plate at its lateral edge opposite to the grounded lateral edge comprises a cut-out section having extending therethrough the signal contact elements of the other signal contact element row.

Finally, it is also possible that within each row of the contact element array 44 alternately small and large throughholes are arranged. The small throughholes are in frictional engagement with the grounding contact elements while the large throughholes have the signal contact elements extending therethrough without mechanical and electrical connection to the grounding plate.

Although the invention has been described and illustrated with reference to a specific illustrative embodiment thereof, it is not intended that the invention be limited to this illustrative embodiment. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A connector shell for a multiple wire cable assembly having multiple ground conductors and signal conductors, the connector shell comprising:

a housing having a ground potential, a multitude of contact elements arranged in a longitudinal array, the contact elements being provided for making direct electrical contact to contact elements of a mating connector and comprising:

(i) grounding contact elements for connecting to the ground conductors of cables of the multiple wire cable assembly and (ii) signal contact elements for connecting to the signal conductors of the cables of multiple wire cable assembly, a longitudinal grounding plate extending along and in the longitudinal direction of the array of the contact elements, the grounding plate having two lateral edges at least one of which is provided for electrical connection to the ground potential of the housing, and wherein the grounding plate comprises throughholes having the grounding contact elements extending therethrough.

2. The connector shell according to claim 1, wherein the grounding contact elements are frictionally received in the respective throughholes of the grounding plate for making mechanical and electrical contact with the grounding plate within the respective throughholes.

3. The connector shell according to claim 1, wherein the housing comprises a first half and a second half, at least the first housing half comprising an electrically conductive material, and wherein the grounding plate along its grounded longitudinal edge mechanically and electrically contacts the first half.

4. The connector shell according to claim 1, further comprising a socket connector having a plurality of contact elements wherein each contact element comprises a contact pin and a socket for receiving a contact pin of a mating connector.

5. The connector shell according to claim 1, wherein the individual cables of the multiple wire cable assembly comprise coaxial cables or twinaxial cables.

6. The connector shell according to claim 1, wherein the contact elements are provided for receiving terminal connectors having a housing of electrically conductive material, at least one signal contact element arranged within the housing and electrically insulated relatively to the housing and electrically connected to a signal element of the array of contact elements and at least one ground contact element arranged within the housing as well as electrically connected thereto and electrically insulated relatively to the signal contact element of the housing and electrically connected to a grounding contact element of the array of contact elements.

7. The connector shell according to claim 1, wherein the grounding plate has several cut-out sections and wherein each of the cut-out sections has at least one signal contact element extending therethrough without contacting the grounding plate.

8. The connector shell according to claim 7, wherein the cut-out sections are designed as throughholes in the grounding plate and wherein each of these throughholes has a signal contact element extending therethrough with the signal contact element being electrically insulated from an edge of the respective throughhole.

9. The connector shell according to claim 1, wherein the grounding plate has at least one cut-out section having the signal contact elements extending therethrough without contacting the grounding plate.

10. The connector shell according to claim 1, wherein the longitudinal array of the contact elements comprises at least one row of grounding contact elements and at least one row of signal contact elements, the rows of grounding and signal contact elements being arranged adjacent to each other.

11. The connector shell according to claim 10, wherein one of the signal contact element rows or the at least one signal contact element row is arranged opposite to the grounded longitudinal edge of the grounding plate and wherein the grounding plate comprises a cut-out section having extending therethrough the signal contact elements of the signal contact element row opposite to the grounded lateral edge extend.

12. The connector shell according to claim 9, wherein the signal contact elements are spaced apart from an edge of a cut-out section or throughhole, respectively.

13. The connector shell according to claim 12, wherein the contact element array comprises two grounding contact element rows and two signal contact element rows, the two signal contact element rows being arranged adjacent to each other and between the two grounding contact element rows, and wherein the grounding plate comprises several cut-out portions through which at least one signal contact element extends.

14. The connector shell according to claim 13, wherein the grounding plate comprises a frame defining the longitudinal edges and transverse edges surrounding a cut-out section having the signal contact elements extending therethrough.

15. The connector shell according to claim 1, wherein at least the grounding contact elements comprise grounding pins.

16. The connector shell according to claim 15, wherein the grounding pins are designed as compliant pins.

17. The connector shell according to claim 1, wherein the grounding plate comprises an electrically conductive layer.

18. The connector shell according to claim 17, wherein the electrically conductive layer extends into the throughholes receiving the grounding pins.

19. The connector shell according to claim 17, wherein the grounding plate is made from electrically conductive material, in particular metallic material.

* * * * *